United States Patent [19]

Grady, II

[11] 4,428,174

[45] Jan. 31, 1984

[54] CONSTRUCTION SYSTEM

[76] Inventor: Clyde C. Grady, II, 25 Pelham Rd., #188, Greenville, S.C. 29615

[21] Appl. No.: 27,028

[22] Filed: Apr. 4, 1979

[51] Int. Cl.[3] ..... E04C 3/10

[52] U.S. Cl. ..... 52/741; 52/227; 52/585

[58] Field of Search ..... 52/227, 228, 285, 585, 52/583, 741

[56] References Cited

U.S. PATENT DOCUMENTS 2,971,295 2/1961 Reynolds ..... 52/228

3,295,286 1/1967 Schaich ..... 52/227 X 3,962,088 6/1976 Kuhlenschmidt et al. ..... 52/227 X

*Primary Examiner*—Carl D. Friedman

[57] ABSTRACT

A method has previously been disclosed in the application with Ser. No. 828,312, now U.S. Pat. No. 4,324,037, filed on Aug. 29, 1977 for the construction and assembly of concrete modular units.

The present application presents improvements over the methods and embodiments of application Ser. No. 828,312 and the other existing art in its gretaer ease of assembly and reduced cost by virtue of its improved design.

3 Claims, 8 Drawing Figures

CONSTRUCTION SYSTEM

BACKGROUND OF THE INVENTION

It is known in the art to fabricate modular units of concrete for assembly into arrays as in Patent Application Ser. No. 828312 wherein load distributing plates of hardened substance are comolded with the concrete to dissipate point stresses on the abutting surfaces.

The present invention likewise utilizes load distributing surfaces which are comolded with the concrete of the modular unit.

In the present invention, however, the points of contact of the load distributing surfaces of adjacent units are three in number. These three points of contact form a plane of contact which exhibits exceptional stability with a reduced cost over extensive metal contact surfaces.

Also in the present invention by virtue of the geometric placement of the holes through which the stressing rods are passed, there is created an increased ease of fastening of the modular units at those points where one planar array of the units meets another array as in the formation of the corner of a building.

DESCRIPTION OF THE INVENTION

Figures 1, 2, 3:
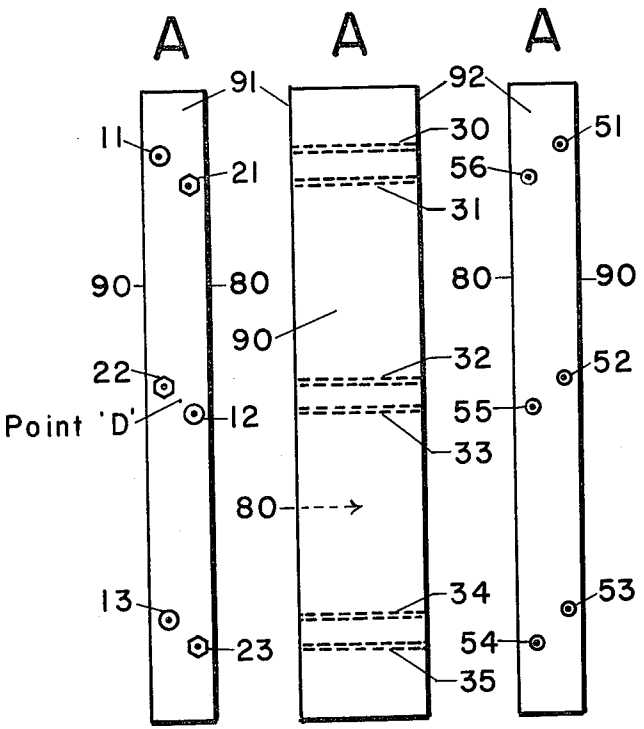
FIG. 1 shows the left edge of module A.
FIG. 2 shows a side view of module A.
FIG. 3 shows the right edge of module A.

In FIGS. 1 thru 3 are presented three different views of a module A. FIG. 1 shows in frontal view the left edge 91 of module A. FIG. 2 shows a side view of module A. FIG. 3 shows in frontal view the right edge 92 of a module A.

In FIG. 1 can be seen washers 11, 12, and 13 which are attached to the surface of edge, 91, as by comolding or by other means. In FIG. 1 there can also be seen threaded nuts 21, 22, and 23 which are similarly attached but recessed so that they do not protrude as far above the surface of edge 91 as washers 11, 12, and 13.

In FIG. 3 can be seen washers 51, 52, 53, 54, 55, and 56 which are attached to the surface of the right hand edge 92, of module A by comolding or by other means so as to form a smooth even interface between the metal surfaces and the concrete.

In FIG. 2 there is shown by dotted lines openings 30, 31, 32, 33, 34, and 35 passing through module A. Opening 30 is situated such that it passes between or connects washer 51 and washer 11. Similarly, opening 31 connects nut, 21, and washer 56; opening 32 connects nut 22 and washer 55; opening 33 connects washer 12 and washer 55; opening 34 connects washer 13 and washer 53; opening 35 connects nut 23 and washer 54.

Figures 4, 5, 6:
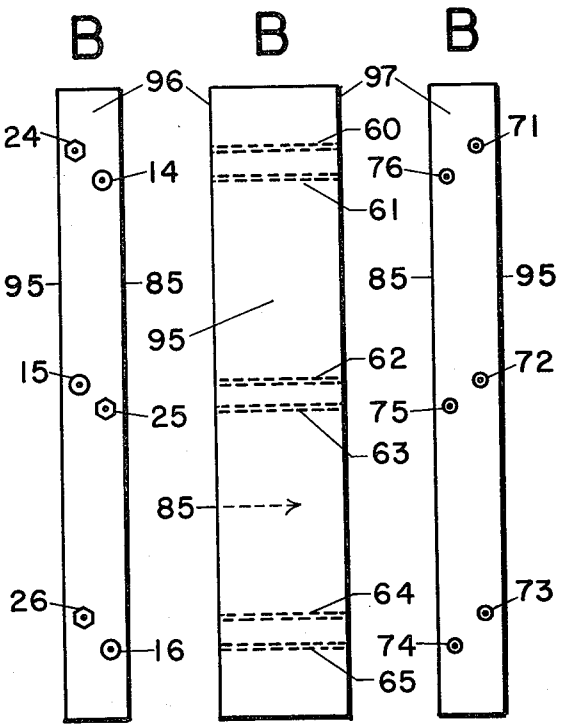
FIG. 4 shows the left edge of module B.
FIG. 5 shows a side view of module B.
FIG. 6 shows the right edge of module B.

In FIGS. 4 through 6 are presented three different views of a module B. FIG. 4 shows in frontal view the left edge, 96, of module B. FIG. 5 shows a side view of module B. FIG. 6 depicts in frontal view the right edge 97 of a module B.

In FIG. 4 can be seen washers 14, 15, and 16 which are attached to the surface of edge, 96, as by comolding or by other means. In FIG. 4 there can also be seen threaded nuts 24, 25, and 26 which are similarly attached, but recessed so that they do not protrude as far above the surface of edge 96 as washers 14, 15, and 16.

In FIG. 6 can be seen washers 71, 72, 73, 74, 75 and 76 which are attached to the surface of the right hand edge, 97, of module B as by comolding or by other means.

In FIG. 5 there is shown by dotted lines openings 60, 61, 62, 63, 64 and 65 which pass through a module B. Opening 60 is situated such that it passes between or connects washer 71 and nut 24. Similarly, opening 61 connects washer 76 and washer, 14; opening 62 connects washer 72 and washer 15; opening 63 connects washer 75 and nut 25; opening 64 connects washer 73 and nut 26; opening 65 connects washer 16 and washer 74.

Figure 7:
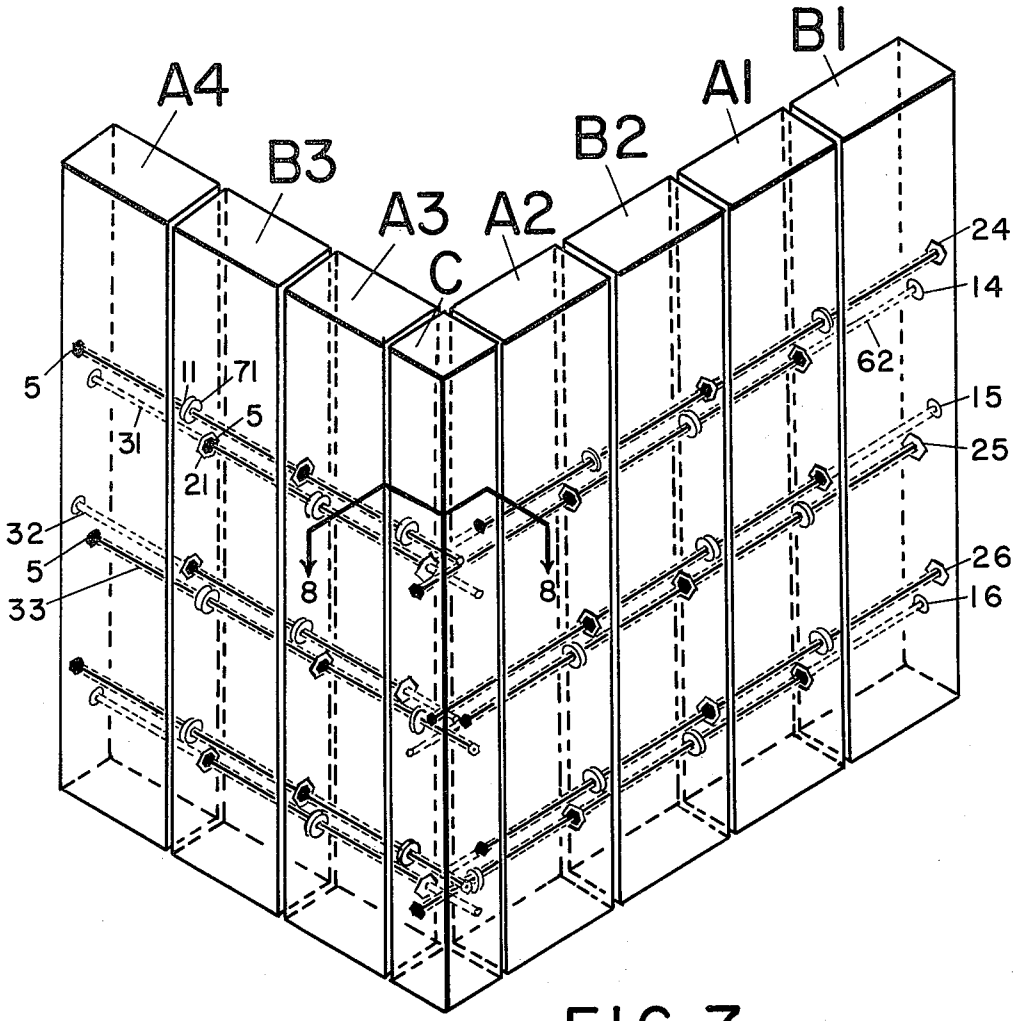
FIG. 7 shows an assembled array of modular units.

FIG. 7 depicts an assembled array of modular units whereby said array is assembled from a number of modules of type A and also a number of modules of type B. There is also shown a module of type C which joins a one dimensional array composed of modules A and modules B to another one dimensional array composed of modules A and B as in, but not limited to, the joining of one wall of a building to another wall of a building at a corner.

The assembly of the total array of FIG. 7 will now be described to demonstrate one of the many possible modes of constructions made possible with the use of modules A and B and variations thereof.

Module B1 is first placed vertically. Module A1 is then positioned adjacent to module B1 so that edge 91 of module A1 is placed in abuttment with edge 97 of module B1. In this position washer 71, of module B1 is directly opposite and in contact with washer 11 of module A1 so that opening 60 of module B1 and opening 30 of module A1 are aligned and form one continuous passage; washer, 76, of module B1 is directly opposite but not in contact with nut 21 of module A1 by virtue of the recess of nut 21 into the surface of edge, 91, so that opening 61 of module B1 and opening 31 of module A1 are aligned and form one continuous passage; washer 72 of module B1 is directly opposite but not in contact with nut 22 of module A1 by virtue of the recess of nut 22 below the surface of edge 91 and opening 32 of module A1 forms a continuous passage with opening 62 of module B2; washer 12 of module A1 is directly opposite and in contact with washer 75 of module B1 so that passage 33 of module A1 and passage 63 of module B1 form a continuous passage; washer 73 of module B1 is directly opposite and in contact with washer 13 of module A1 so that opening 34 of module A1 forms a continuous passage with opening 61 of module B1 by virtue of alignment; and also washer 74 is directly opposite but not in contact with nut 23 of module A1 by virtue of the recess of nut 23 into the surface, 91, of module A1 and thereby passage 35 of module A1 and passage 65 of module B1 form a continuous passage. There are therefore three points of contact between module A1 and module B1.

A threaded bolt, 5, is then inserted thru module A1 and module B1 by means of openings 30 and 60 and threadably fastened to nut, 24, of module B1 so that the head of said bolt, 5, rests against washer, 51, of module A.

A second bolt, 5, is then inserted through module A1 and module B1 by means of openings 33 in module A1 and opening 63 of module B1 and thereby said bolt, 5, is threadably connected to nut, 25, of module B1. The head of said bolt, 5, thereby rests against washer 55 of module A1.

A third bolt, 5, is then inserted thru passage, 34, of module A1 and passage, 64, of module B1 and threadably connected to nut 26 of module B1.

A module B2, which is like in kind to module B1, is then positioned adjacent to module A1 so that edge 96 of module B2 is placed in abuttment with edge 92 of module A1. In this position nut 24 of module, B2, is directly opposite but not in contact with the head of the bolt, 5, which rests against washer 51 of module A1, and passage 30 of module A1 is aligned with passage 60 of module B2; washer 14 of module B2 is directly opposite and in contact with washer 56 of module A1 so that passage 31 of module A1 and passage 61 of module B2 are aligned and form a continuous passage; washer 15 of module B2 is directly opposite and in contact with washer 52 of module A1 so that passage 32 of module A1 is aligned with passage 62 of module B2 and thereby forms a continuous passage; nut 25 of module B2 is directly opposite but not in contact with the head of the bolt, 5, which rests against washer 55 of module A1 by virtue of the recess of nut 25 below the surface of module B2; nut 26 of module B2 is directly opposite but not in contact with the head of the bolt, 5, which rests against the washer 53 of module A1, by virtue of the recess of nut 26 below the surface, 96, of module B2; washer 16, of module B2 is directly opposite and in contact with washer 54 of module A1 so that opening 35 of module A1 and opening 65 of module B2 are aligned and form a continuous passage.

A threaded bolt, 5, is then inserted thru module B2 and module A1 by means of opening 61 in module B2 and opening 31 in module A1 and threadably connected to nut, 21, of module A1, and the head of the bolt, 5, rests against washer 76 of module B2.

A second threaded bolt, 5, is then inseted in turn thru module B2 and module A1 by means of opening 62 in module B2 and opening 32 in module A1 and threadably connected to nut 22 of module A1 so that the head of the bolt, 5, rests against washer 72, of module B2.

A third threaded bolt, 5, is then inserted in turn thru module B2 and module A1 by means of opening 65 in module B2 and opening 35 of module A1, whereby said bolt, 5, is threadably connected to nut 23 of module A1 so that the head of the bolt, 5, rests against washer 74 of module B2.

There is thereby formed an array of three modular units which are cojoined such that each modular unit meets its neighbors at only three points in a plane of contact and at these three points the contact is metal to metal.

To this array of modular units can be fastened an additional modular unit A2. This is accomplished by the attachment of module A2 to module B2 in the manner in which A1 was attached to module B1.

Figure 8:
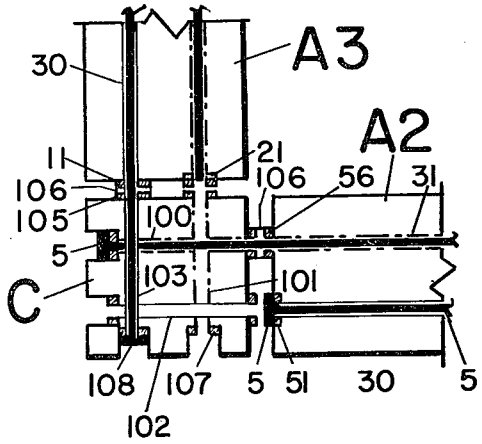
FIG. 8 is a section along lines 8—8 of FIG. 7.

To explain the attachment of unit C to the assembled array of modular units composed of units A2, B2, A1, and B1 reference is made to FIG. 8. FIG. 8 is a section along line 8—8 of FIG. 7 taken along a horizontal plane which passes thru the openings 30 of the A type modular units and openings 60 of the B type modular units. The outline of the openings 31 in the A type modular units is also shown in broken dotted lines in FIG. 8 (although these openings are not in the same horizontal plane as the openings 30 in the A type modular units as shown in FIG. 7). This is done in order to facilitate explanation of the manner in which module C is attached to the array composed of modules A2, B2, A1, and B1, and also the way in which module A3 is attached to module C.

It can be seen in FIG. 8 that a bolt, 5, is inserted through an opening 100 in module C and the opening 31 in module A2. This threaded bolt is threadably fastened to nut 21 (not shown in FIG. 8) of module A2.

There is also shown in FIG. 8 that after a modular unit A3 has been placed adjacent to module C that a bolt, 5, is inserted thru opening 30 in module A3 and thru an opening in module C, 103, which is aligned with opening 30 of module A3. The head of the said bolt, 5, rests against the washer 51 of unit A3 (not shown in FIG. 8)

There are depicted in FIG. 8 also washers 105 which are comolded with unit C at the time of its manufacture. There are also shown metal spacers, 106, which are compressed in turn between a washer 105 and a washer 11 of module A3 and also between a washer 105 and a washer 56 of module A2.

A horizontal plane in FIG. 7 through the openings 32 of the A type modules and 62 of the B type modules could be used to construct a figure similar to FIG. 8.

This figure (not shown) would show bolts 5 through the openings corresponding to openings 101 and 102 of FIG. 8. The bolt, 5, passing through an opening corresponding to opening 101 would also pass through opening 33 of modular unit A3, whereby the head of said bolt, 5, would rest against washer 55 of unit A3 when the bolt was threadably connected to a nut in the manner of nut 108 in FIG. 8. Between the washer 105 of module C and washer 12 of unit A3 would be positioned a metal spacer 106. The bolt, 5, passing through the opening corresponding to opening 102 would also pass through opening 32 of modular unit A2 and be threadably connected to nut 22 of module A2. Between the washer 52 of modular unit A2 and the washer 105 of unit C would be positioned a metal spacer 106. In this drawing there would be no bolts, 5, through the openings corresponding to opening 103 and 100 in FIG. 8.

A horizontal plane in FIG. 7 through the openings 34 of the type A modules and openings 64 of the type B modules could used to construct a figure similar to FIG. 8.

This figure (also not shown) would show bolts, 5, through the openings corresponding to openings 103 and 100 of FIG. 8. The bolt passing through the opening corresponding to opening 103 would also pass through opening 34 of modular unit A3, whereby the head of said bolt 5 would rest against washer 53 of unit A3 when the bolt, 5, was threadably connected to a nut corresponding to nut 108 in FIG. 8. Between the washer 13 of module A3 and the washer 105 of module C would be placed a metal spacer 106. The bolt passing through the opening corresponding to opening 100 of FIG. 8 would also pass through the opening 35 of module A2 and be threadably fastened to nut, 23, of module A2. Between the washer 54 of module A2 and the washer 105 of module C would be positioned a spacer 106. In this drawing there would be no bolts, 5, through the openings corresponding to openings 101 and 102 just as there were no bolts, 5, through these openings in FIG. 8.

To complete the array shown in FIG. 7, module B3 would then be attached to module A3 in the manner in which modular unit B2 was attached to module A1. In turn module A4 would be attached to module B3 in the manner in which module A1 was attached to module B1.

It should be noted that a module B can be created from a module A by rotation about an axis perpendicular to the plane of the paper in FIG. 1 whereby the said axis is represented by point D in FIG. 1.

It should also be noted that there exist other modular units which can be configured by the reflection through mirror planes placed adjacent to or passing through the units depicted in FIGS. 1 and 2 which can utilize equally as well the principles contained in this invention.

It should also be noted that the principles contained in this invention can be utilized in the construction of arrays propagated in two and three directions at the same time. This configuration of two and three dimensional arrays can be accomplished by providing openings in a modular unit A (or B) which would be in either of the two mutually perpendicular planes which are perpendicular to the vertical plane containing openings 51, 52, and 53. It could be provided that none of the additional openings intersect one another or any of the openings shown in FIG. 1.

It is, in addition, noted that in the case of the adjoining of a module A to a module B, the three points of contact between adjacent modular units may in fact be washer, 76, of a module B with nut 21 of a module A, washer 72 of a module B with nut ww of a module A, and washer 74 with nut 23. Consistent with this mode of contact in the method of adjoining a module A to a module B in the case of the adjoining of a module B to a module A, the three points of contact between adjacent modular units would be nut 24 of a module B with washer 51 of a module A, nut 25 of a module B with washer 55 of a module A, and nut 26 of a module B with a washer, 53, of a module A.

I claim:

1. A method for the formation of arrays of modular units such that in the construction of an assembled array of more than one modular unit contact between any two of the modular units placed in abutment in the formation of the array is restricted to the contact of three load distributing surfaces comolded on the first modular unit of the aforesaid two modular units with three load distributing surfaces comolded on the second of the aforesaid two modular units, wherein each modular unit of the aforesaid two modular units is connected to the other modular unit of the aforesaid two modular units by means of bolts or other connectors, where said bolts or other connectors pass through parallel apertures in each of the aforesaid two modular units, wherein said apertures are arranged into more than one group of at least two apertures to a group such that all aforesaid apertures in a first group of the aforesaid groups lie in a plane which is parallel to the plane formed by any second group of apertures, Wherein at least one aperture, designated as the first aperture, in each group of apertures is provided with a fastening means such as an internally threaded nut which is attached to either of the aforesaid two modular units such that a bolt or other means of connection may be passed through the aforesaid first aperture and fastened to the aforesaid fastening means.

2. The method of claim 1 wherein there is further provided a means for changing the direction of propagation of an array of modular units being assembled by means of a particular type of modular unit termed a corner unit, wherein said corner unit is provided with more than one set of intersecting apertures, wherein one aperture of each aforesaid intersecting pair of apertures is colinear with an aperture provided in a modular unit forming one direction of propagation of the array of modular units while a second aperture of the aforesaid pair of intersecting apertures is colinear with an aperture provided in a modular unit forming a second direction of propagation of the array, such that the passage of a bolt or other means of connection through a single aperture of a first pair of intersecting apertures allows connection of the corner unit to a modular unit forming one direction of propagation of the array of modular units while the passage of a second bolt through a single aperture of a second pair of intersecting apertures allows connection of the corner unit to a modular unit forming a second direction of propagation of the array of modular units aforesaid.

3. A method for the assembly of an array of modular units consisting of the steps of:

(a) providing a first modular unit consisting of a substantially rectangular solid through which more than one group of at least two parallel apertures is provided such that at least one aperture in each aforesaid group of apertues is fitted with a threaded connector such as a nut or other means of connection comolded or attached to a surface of the modular unit such that a bolt passing through the aforesaid one aperture can be threadably attached to the aforesaid threaded connector of the first modular unit, while the second aperture in the aforesaid group of apertures contains no threaded fastener such that rotation of the modular unit about an axis parallel to the aforesaid apertures causes an interchange in the position of the aperture fitted with a threaded fastener and the aperture not fitted with a threaded fastener in at least one group in the aforesaid groups of apertures.

(b) providing a second modular unit which is substantially identical to the first modular unit.

(c) placing the second modular unit adjacent to the first modular unit such that the apertures of the first modular unit fitted with threaded fasteners align with the apertures fitted with threaded fasteners in the second modular unit and the apertures not fitted with threaded fasteners in the first modular unit align with the apertures not fitted with threaded fasteners in the second modular (d) rotating either the first or the second modular unit about an axis parallel to the apertures in the modular unit rotated such that an interchange occurs in the position of at least one aperture to which a threaded fastener is fitted with the position of at least one aperture not fitted with a threaded fastener in the aforesaid rotated modular unit.

(e) attaching the first modular unit to the second modular unit by means of a threaded connector such as a bolt which is inserted through an aperture to which a threaded fastener such as a nut is not fitted in the first modular unit and an aperture in the second modular unit to which a threaded fastener has been fitted.

* * * * *